United States Patent [19]

LaDue

[11] Patent Number: 4,792,144

[45] Date of Patent: Dec. 20, 1988

[54] METHOD OF PLAYING A SPORT

[76] Inventor: Edward LaDue, 321 W. 78th St., New York, N.Y. 10024

[21] Appl. No.: 45,030

[22] Filed: May 1, 1987

Related U.S. Application Data

[63] Continuation of Ser. No. 9,994, Feb. 7, 1979, abandoned.

[51] Int. Cl.[4] ..... A63B 67/18

[52] U.S. Cl. ..... 273/411; 273/126 R

[58] Field of Search ..... 273/1 B, 411, 398, 402, 273/85 R, 126 R; 272/3

[56] References Cited

PUBLICATIONS

"Washington Post", p. N14, 11/9/80.

"Washington Post", p. C8, 11/5/78.

*Primary Examiner*—Richard C. Pinkham

*Assistant Examiner*—T. Brown

*Attorney, Agent, or Firm*—Nolte, Nolte and Hunter

[57] ABSTRACT

A field sport providing an outer boundary defining the playing area and consisting of a wall, fixed or portable, and an inner boundary defining an inner playing field in predetermined space relation from the outer boundary and in which the field the players must remain during play, the distance between the outer and inner boundaries being sufficient to prevent the possibility of contact between the wall and the players. A player passes a playing object (e.g. ball, puck, etc.) by projecting it against the wall to rebound back onto the playing field while the player remains in the field. Goals at either end of the playing area are provided. Goal keepers must remain between the inner and outer boundaries at either end of the playing area.

1 Claim, 2 Drawing Sheets

METHOD OF PLAYING A SPORT

This application is a division of Ser. No. 009,994, filed 2/2/79, now abandoned.

BACKGROUND OF THE INVENTION

The existing requirements of a field area for soccer, hockey, and other team sports limit the number of facilities available for playing these sports and therefore the number of participants in team sports. The invention permits the playing of team sports where the skills involved in these sports may be enjoyed and developed with rules for team sports compatible with the invention in a much smaller field area. Furthermore, the invention contemplates a sport played within the confines to be described in which physical contact and injuries resulting therefrom are eliminated or at least minimized.

One of the problems of providing a field game for mass participation as opposed to participation only by those who have and have acquired and developed skills, is the problem encountered in playing ball type field games in an open area. The playing ball is not contained and many delays of the game occur to retrieve the ball. In attempting to surround the playing areas with walls as a solution to this problem, the expenses involved providing such a wall presents another and sometime unsurmountable problem. Furthermore, the provision of walls which may be assembled and disassembled readily and stored also presents problems.

Typical prior art attempts are disclosed in U.S. Pat. Nos. 3,883,120 3,986,342 and 4,068,840. A particularly complicated structure for an off the wall game is disclosed in U.S. Pat. No. 4,070,805. Note is also made of the enclosed game disclosed in U.S. Pat. No. 3,758,106 and further wall or panel type structures may be reviewed in U.S. Pat. Nos. 2,873,094 and 3,358,969.

The need for indoor games has recently been acknowledged and an attempt made to provide a field as in the disclosure of such in the Washington Post of Jan. 5, 1978 at page C8.

SUMMARY OF THE INVENTION

The present invention in providing an outer wall spaced from an inner playing field provides a playing environment in which the playing object is contained within a rebounding surface area but by providing a rule that the field players may not pass the inner boundary, physical injuries to the players are avoided which may otherwise have resulted from physical contact with the wall. The wall is preferably constructed as a "knock-down" and therefore is capable of being dismantled for storage and thus the game may be enjoyed in the many thousands of indoor playing fields already in existance; i.e. basketball courts, tennis courts, and the like.

The rules of the game provide that the goal tenders must not enter the playing field, but must remain in that area at the ends of the field between the inner and outer boundaries.

In keeping with the objects of the invention, the playing area of the invention is provided with an outer wall preferably rectangular which defines the total playing area, and an inner boundary which defines the playing field and which playing field is spaced inwardly from the outer wall most particularly along the sides of the rectangular playing area. The inner boundary is also spaced from the outer wall at the ends of the rectangular area. The spacing at the end of the playing area is provided to accommodate special rules for playing the sport of the invention and which requires the goal tenders on either team to remain within the areas defined by the outer wall and inner boundary at the ends of the playing field.

Specific dimensions may be provided for the length and width of the field as well as for the goal openings, all as shall be discussed in more detail. A ball preferably of the soccer type is used in the play of the sport and in a manner for utilizing the type of skills usually developed in the sport of soccer.

In providing a wall of a knock-down construction which may be easily assembled and disassembled and stored; rigidity must be imparted to it even though it may be assembled and disassembled in sections. In this respect whatever construction is utilized, and whatever materials are utilized, basic to the sectional wall construction is the provision of means extending from one wall section to the next adjacent wall section for maintaining the two sections in place and for resisting relative movement upon the impact of the playing ball.

DESCRIPTION OF FIGURES:

In FIG. 1, the outer boundary 10 which comprises an upstanding wall (see FIG. 2) is rectangular and in a preferred embodiment of the invention encloses a playing area of 96 feet by 52 feet sufficient to enclose a basketball court, for instance, which nominally measures 84 feet by 45 feet 9 inches. Thus, the inner boundary 11 may take the form of indicia painted or otherwise inscribed on the floor of a gymnasium or other playing surface as an existing basketball court boundary.

Figure 1:
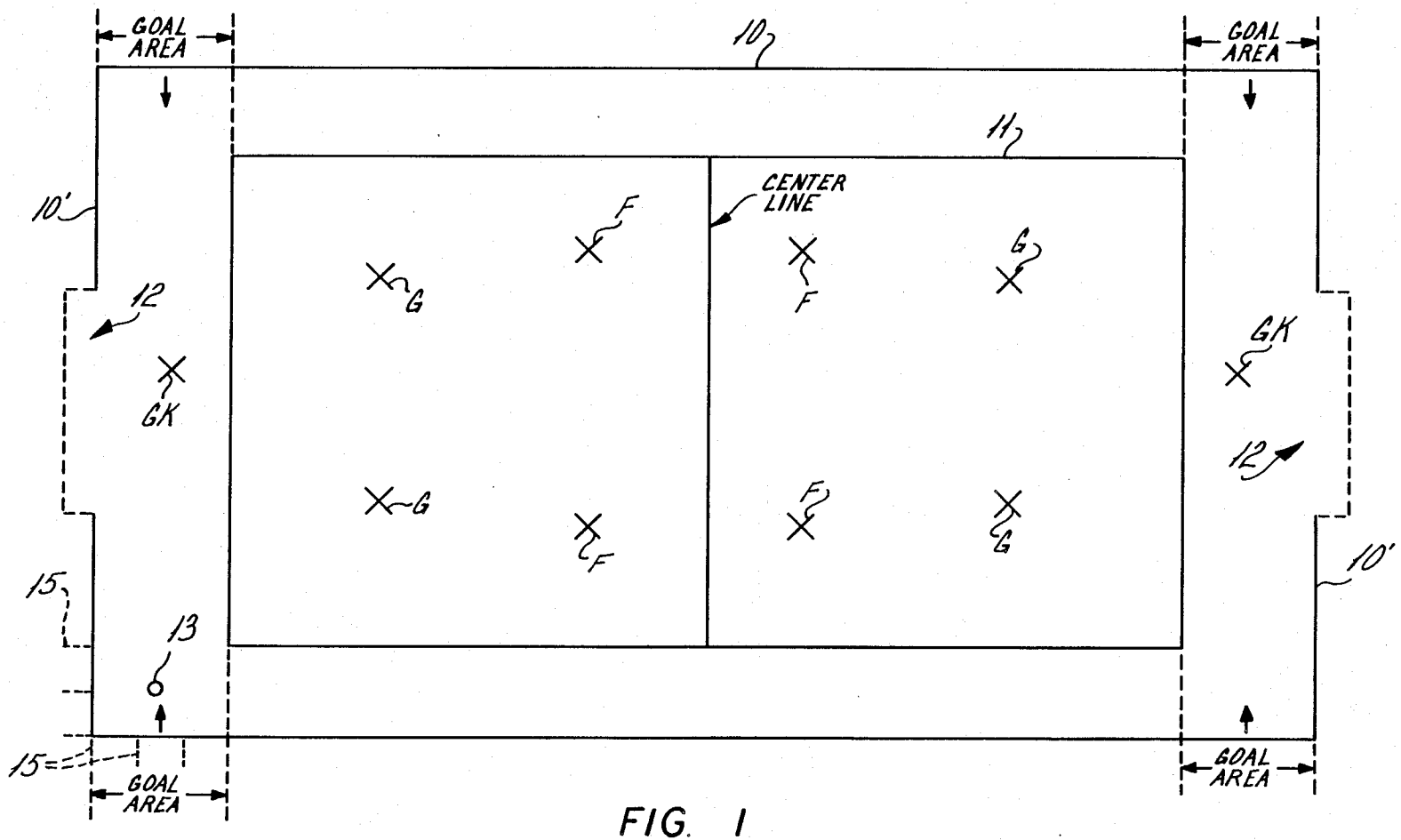
FIG. 1 is a diagrammatic top plan view of the playing area and field of the invention.

The ends 10' of the outer boundary wall are interrupted intermediate their ends to provide a goal area 12 through which the playing ball 13 must pass for a team to score. A goal net may be provided and is depicted in FIG. 1 in dash lines externally of the goal opening 12.

Knee braces 15 provide support and stability to the boundary wall which comprises the plurality of separable panels, each of which is retained by a brace, as shall be discussed.

Preferably the game is played by five men on each team, four of whom are field players, the remaining player being the goal keeper. As shown in FIG. 1 the field players comprise two forwards F and two guards G. The goal keepers are designated GK in the figure.

Figure 2:
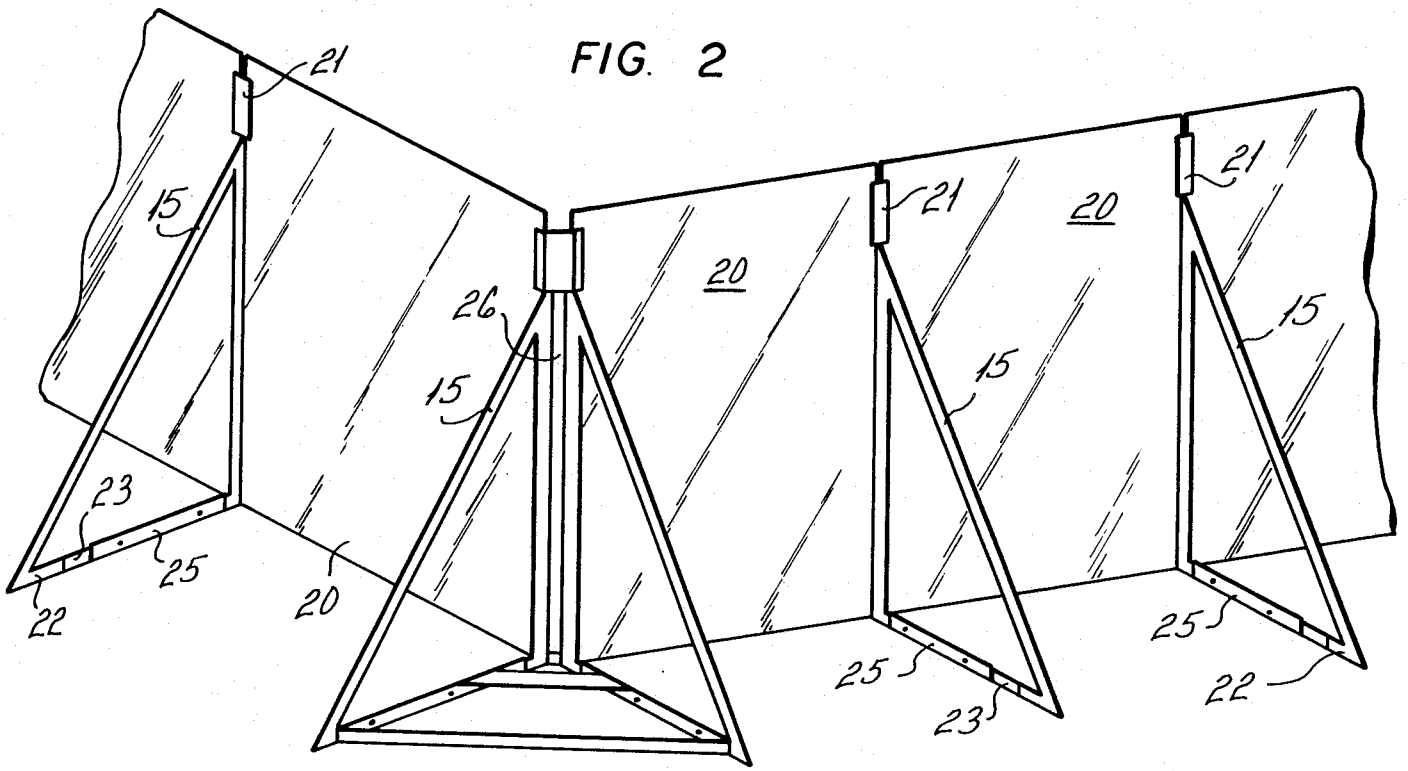
FIG. 2 is a perspective view at the corner of the playing area looking at the outside boundary wall from the outside.

In a preferred embodiment of the wall boundary construction, a plurality of panels 20 (FIG. 2) are connected along their ends and retained in end to end relation via clamp elements 21 or joining pieces. The panels may be variously constructed, but preferably should be transparent so that the game can be viewed through them. Knee braces 15 having horizontal floor support elements 22 extend from their connection to the adjoining panels. The knee braces 15 conventionally comprise the vertical and horizontal struts connected via the inclined element and in the present construction, the vertical strut is interposed between adjacent panels 20 where conventional means, not shown, connect the vertical brace and adjacent panels. In the embodiment disclosed, joining or clamping pieces 21 of conventional construction overlie and connect vertical frame pieces of the adjacent panels and interposed knee brace.

Extending rearwardly from the frame of each panel there may be provided horizontal strut elements 23 which are connected at their lines of adjacency to the horizontal floor supports 22 via further joining pieces 25.

In all instances, bolt and screw fasteners may be utilized as well as dowels and the like to assure stability.

At the corner of the boundary wall, a special corner piece 26 may be provided as a transition element between the two portions of the wall which extend at a right angle to one another. The construction may be conventional so long as it provides a stable connection.

It has been determined that the knee brace construction just described should be quite sufficient to provide wall stability against expected impacts from the ball and accidental collisions with the moving players.

Now follows a set of rules for a game which may be played on the playing area just described. The game is called 'SCRIMMAGE', but, of course, may be called any other appropriate title.

Scrimmage is a ball game played by two teams, each of five players. The object of the game is to put the ball into the opponents goal, the winning team being the one scoring the greater number of goals within the time limit of the game. The game is intended as a non-contact sport.

1. The Playing Area and Playing Field

The playing area shall be rectangular. It shall consist of an enclosure of solid materials of a height up to no less than three (3) feet joined at the corners of the rectangle, and a playing field within such enclosure, the sidelines of which will be parallel to, and no less than three (3) feet from the sides of the enclosure, and the ends of which shall be no less than five (5) feet from the end lines of the closure.

The standard dimensions of the enclosure for competition shall be no less than ninety-six (96) feet in length and no less than fifty-two (52) feet in width.

2. The Goals

There shall be a goal centered at either end of the playing area no less than twelve (12) feet in width and eight (8) feet in height. It shall be an open goal having no net (optionally). The crossbar and posts shall be of equal width, (no less than two (2) inches). The posts of the goal shall be at the end of the playing area.

3. The Ball

The ball shall be spherical and inflated to a circumference not greater than twenty-eight (28) inches nor less than twenty-four (24) inches and weigh between twelve (12) and sixteen (16) ounces.

4. The Teams

There shall be two teams of five (5) players, each consisting of two (2) forwards, two (2) guards, and a goal-keeper. A player designated a goalkeeper, during play, may not leave the "goal area".

5. Playing Area

Goal area: that area beyond the end lines of the playing field, between the end lines of the playing field and the enclosure and goal opening.

Playing Field: shall be of two halves, offensive and defensive, joined at a center line equidistant from and parallel to the end lines of the playing area.

6. Game Duration

The game shall be played over a period of four (4) fifteen minute quarters. There shall be rest periods of three (3) minutes between quarters and five (5) minutes between halves. In the event of a tie score at the end of the fourth quarter, the winner shall be determined in succeeding periods of a duration of ten (10) minutes, each with two minute rests between such periods.

7. Time Outs (a) After a goal is scored and until play again commences;

(b) Either team, while in control of the ball, may call a ten second time out to allow for substitution of a player or players; no more than ten (10) such time outs may be called in any quarter;

(c) Either team, while in possession of the ball, may, in any quarter, call no more than three (3) one minute time outs for any purpose;

(d) A time out by a team is "called" by a member of that team requesting it of an Official and is calculated from the time the Official grants the request;

(e) An Official may call a time out at any time a player is injured or repairs are required or for any purpose deemed reasonable by the Official for such time as the Official may feel the circumstances require.

8. The Play (a) Initial possession of the ball is determined by a flip of a coin;

(b) The ball is put in play, on a signal from an Official, by a goalkeeper of the team winning the coin flip by a pass to a teammate in the goalkeepers half of the playing area; the defending team will remain in its half of the playing area until an offensive player other than the goalkeeper touches the ball;

(c) Only the goalkeepers are permitted in the goal areas;

(d) The ball may be moved about the playing field or controlled by a player using any part of his body other than his hands. However, a goalkeeper is permitted to use his hands, but only in preventing the ball from entering the goal and in putting the ball in play;

(e) The ball may be ricocheted off the playing area enclosure in passing or moving the ball about the playing area. A ball entering the goal directly off the playing area enclosure will not, however, count as a score.

9. Substitutions

Substitutions may be made freely during any time out period and players and substitutes may return to the game as many times as may be desired. A substitute may not enter the playing field until the player he is replacing has left the playing field. All players shall enter and leave through the goal defended by their team at the time of the substitution, and shall report their presence and position to Officials.

10. Alternate Fields

The teams shall change goals at half time.

11. Violations

The following violations, if by an offensive player, result in a turnover of possession of the ball, if by a defensive player withdrawal of the player from the playing area beyond his team's goal until his team has ball control and has crossed the center line of the playing field. The ball is put in play on turnover or withdrawal as per Rule 8(b):

(a) Stepping beyond the playing field perimeter;

(b) Using the hands to control or move the ball (except goalkeeper);

(c) Hitting the ball beyond the wall enclosure (or off the playing field if the ball does not return to the playing area);

(d) Delaying the game, including "hanging" or "lagging" at the opponent's goal;

(e) Unsportsmanlike conduct;

(f) Having too many players on the field.

12. Penalties

Since this sport is intended to be non-contact, a penalty will be assessed for;

(1) Deliberate contact with opposing players other than in reasonable pursuit of the ball. Tripping, pushing, holding, charging or checking are forbidden.

(2) The game Official shall judge whether any physical contact could reasonably have been avoided.

(3) For such physical contact:

(a) The ball is awarded to the opposing team in their half of the playing field for a kick into the other half of the playing field; this kick puts the ball in play and may lead to a goal;

(b) The team against which the penalty is assessed will have no forwards on the playing area at the time of the penalty kick and until the ball recrosses the center line of the playing field;

(c) A player who is the cause of two penalty kicks shall be expelled from the game after the second kick is taken, a player guilty of one such violation shall be warned by the Official of the possibility of expulsion for a repetition;

(d) Where expulsion results in a team being unable to field a full complement of players, that team shall continue to play with the reduced number.

13. Equipment

Players shall wear shorts, t-shirts, stockings and such footwear as will not be damaging to field or player in the judgment of Officials. Players may wear such additional padding and protective devices as may be deemed neither potentially harmful nor dangerous to others nor offer an undue advantage to a team or player. An Official shall determine whether this rule is properly observed and may expel anyone from the field not conforming to his ruling.

Goalkeepers shall wear such variations to the standard uniform of the team (normally, a different t-shirt) as to distinguish them from other players on the team.

14. Officials

One Official shall be sufficient in non-regulated competition (where process of elimination to an ultimate winner is used); two Officials shall be the minimum requirement in regulated competition.

In non-regulated competition an Official may be designated by the teams. In regulated competition the Officials will be designated by the body governing the competition.

Officials shall signal by means of whistles to be carried by them during the game.

Officials in regulated competition shall wear slacks and striped shirts to be clearly distinguishable from players and such footwear as is commensurate with the surface of the playing field.

15. Officials' Supervision

An Official will indicate a violation resulting in a turnover by whistling, taking possession of the ball, and pointing to the player violating the rules. He will then pass the ball to the goalkeeper of the team awarded the ball.

An Official will indicate a penalty by whistling, taking possession of the ball, placing it at the center line and advising the team against whom there is a penalty of the fact and will await the removal of the forewards from the field before instructing the opposite team to kick the ball.

It is to be noted that the description above of the various elements, the constructions thereof, the dimensions and the like are illustrative and are not to be considered as limiting features of the invention which may only be limited by the claims.

What is claimed is:

1. In a field sport played on a field with a playing object and in which opposing teams comprise a plurality of field players and in which the playing field is rectangular and is surrounded by a vertical wall spaced from the rectangular playing field thereby providing out-of-bounds areas between the field and the vertical wall, the method of playing comprising the players or any one of them moving the playing object within the playing field while remaining within the playing field, the players continuing in play and they or any of the players moving while the playing object is outside the playing field to intercept the playing object when it reenters the playing field, said players continuing play with the playing object without interruption after its re-entry onto the playing field from the surface of the upstanding wall, the players restricting themselves within the playing field while the playing object is projected to the surface of the vertical wall, bounces off the wall and re-enters the playing field to avoid injury within the areas between the playing field and the vertical wall and to avoid penalties for being out-of-bounds.

* * * * *

UNITED STATES PATENT AND TRADEMARK OFFICE

CERTIFICATE OF CORRECTION

PATENT NO. : 4,792,144
DATED : December 20, 1988
INVENTOR(S) : Edward LaDue

It is certified that error appears in the above-identified patent and that said Letters Patent is hereby corrected as shown below:

Column 6, line 31, "playing" should be --play--;

line 33, after "field" insert --said one player passing the playing object by projecting the playing object to the surface of the vertical wall outside the playing field to bounce the playing object off the vertical surface back onto the playing field--.

Signed and Sealed this

Thirteenth Day of June, 1989

*Attest:*

DONALD J. QUIGG

*Attesting Officer*

*Commissioner of Patents and Trademarks*